United States Patent [19]

Yoder

[11] Patent Number: 4,569,156

[45] Date of Patent: Feb. 11, 1986

[54] VIBRATORY FINISHING APPARATUS

[75] Inventor: Ronald L. Yoder, Topeka, Ind.

[73] Assignee: Universal Consolidated Methods, Inc., Topeka, Ind.

[21] Appl. No.: 615,035

[22] Filed: May 29, 1984

Related U.S. Application Data

[63] Continuation-in-part of Ser. No. 336,457, Dec. 31, 1981, Pat. No. 4,467,563.

[51] Int. Cl.[4] ..... B24B 31/06

[52] U.S. Cl. ..... 51/163.1

[58] Field of Search ..... 51/163.1, 163.2, 164

[56] References Cited

U.S. PATENT DOCUMENTS

| | | | |
|---|---|---|---|
| 2,143,610 | 1/1939 | Muller | 51/163.1 |
| 2,208,077 | 7/1940 | Linke | 51/7 |
| 2,222,776 | 11/1940 | Linke et al. | 51/163.1 |
| 2,222,777 | 11/1940 | Linke | 51/7 |
| 2,389,337 | 11/1945 | Zademach | 51/163.1 |
| 3,045,397 | 7/1962 | Hesslenberg | 51/7 |
| 3,071,900 | 1/1963 | Balz | 51/163.1 |
| 3,093,940 | 6/1963 | Balz | 51/163.1 |
| 3,253,369 | 5/1966 | Reichert | 51/163.1 |
| 3,336,701 | 8/1967 | Moore | 51/163.1 |
| 3,541,738 | 11/1970 | Rampe | 51/163.1 |
| 3,552,068 | 1/1971 | Van Fossen | 51/163.1 |
| 3,624,970 | 12/1971 | Balz | 51/163.1 |
| 3,680,266 | 8/1972 | Shiplov | 51/163.1 |
| 4,059,926 | 11/1977 | Rampe | 51/163.1 |
| 4,077,162 | 3/1978 | Balz | 51/163.1 |

FOREIGN PATENT DOCUMENTS

| | | | |
|---|---|---|---|
| 627951 | 10/1978 | U.S.S.R. | 51/7 |

*Primary Examiner*—Harold D. Whitehead

*Attorney, Agent, or Firm*—George A. Gust

[57] ABSTRACT

Vibratory finishing apparatus comprises an elongated container having an open top. The container is disposed with its longitudinal axis horizontal and may be divided into a plurality of individual compartments of selected size arranged in tandem. A plurality of drain orifices are provided in the bottom of such compartments, in one form as apertured inserts, whereby the flow of fluid and particulate matter is through each of said compartments individually from the top to the bottom thereof and to a common fluid collecting channel. Means are provided for vibrating the container and its compartments in unison. Minute vibratory motion between metallic parts and medium within such compartments and the further enmasse orbital movement of such mass about a common longitudinal axis are utilized to finish and in some instances polish such parts.

19 Claims, 16 Drawing Figures

VIBRATORY FINISHING APPARATUS

CROSS REFERENCE TO RELATED APPLICATION

This application is a continuation-in-part of my copending application Ser. No. 336,457 filed Dec. 31, 1981 issued as U.S. Pat. No. 4,467,563, dated Aug. 28, 1984.

BACKGROUND OF THE INVENTION

1. Field of the Invention

The present invention relates to the finishing and polishing of metallic parts and more particularly to improvements in apparatus for performing such finishing and polishing.

2. Description of the Prior Art

Typical of the art of finishing apparatus are the following U.S. Pat. Nos. Re. 27,084; 2,882,024; 3,093,940; 3,100,088; 3,103,086; 3,161,997; 3,400,495; 3,423,884; 3,435,564; 3,466,815; 3,624,970; 3,871,135 and 3,893,266. In carrying out finishing or polishing of metallic parts, a finishing or polishing machine has been employed which includes a tub or container with a semicylindrical bottom. Such tub configurations are disclosed in certain of the above patents, including U.S. Pat. Nos. 3,093,940; 3,103,086; 3,161,997; 3,423,884; 3,435,564 and 3,624,970. Mounted directly on the tub has been a vibrator comprising an electric motor driving an eccentric weight which rotates on an axis usually parallel to the axis of the semi-cylindrical bottom of the tub. The tub and the vibrator are supported as a unit for independent movement in space on suitable spring mountings. The parts to be finished are placed in the tub along with abrasive media such as stone chips, steel balls or the like. Steel balls are generally used for polishing.

When the vibrator is actuated, the mass of polishing medium and the parts are vibrated with the result that there is minute vibratory motion between the parts and the polishing medium and the further enmasse orbital movement of the mass about an axis extending generally parallel to the axis of the semi-cylindrical bottom of the tub.

It is conventional to employ a liquid finishing compound which is added to the mass. Examples of such finishing compounds include detergents, soaps, surfactants, wetting agents and the like, typical of these being disclosed in the aforesaid U.S. Pat. No. 3,161,997. Such tubs are usually provided with means for draining off such liquid compounds as well as particulate matter in the form of fines or sediment coming either from the parts or the finishing medium present in the mass.

The aforesaid tubs are for the most part in single, compartmental form, especially those which are elongated. Those which conform more to cup or barrel shapes and are vibrated generally about an upright axis are in some instances compartmented.

SUMMARY OF THE INVENTION

In this invention, the finishing apparatus includes an elongated container having an open top, the container being disposed with its longitudinal axis generally horizontal. A number of partitions are selectively provided within the container for dividing it into a plurality of individual compartments tandemly arranged. A multiplicity of drain orifices are provided in the bottom of all of such compartments whereby flow of fluid and particulate matter is through each compartment from the top to the bottom thereof. Means are provided for vibrating the container and its compartments in unison.

In a preferred embodiment, the container and compartments are part cylindrical about the longitudinal axis with the vibrating means imparting a vibratory motion of an orbital nature to the container which causes finishing material and parts within the compartments to rotate generally about such axis. The part-cylindrical shape is greater than a half cylinder with the transverse dimension of the open top being less than the maximum transverse dimension or diameter of such part-cylindrical shape. Preferably, the internal surfaces of the compartments are covered with a resilient, cushioning elastomeric material. A separately molded urethane liner may be employed.

In order to produce uniform vibration of the container and all of the compartments therein, the container is rigidly mounted upon a supporting frame which in turn is resiliently supported on a stationary platform. In one form the vibrating means includes a shaft journaled for rotation within bearings mounted on the supporting frame, the shaft extending parallel to the axis of the container and in a location therebeneath. In another form the vibrating means includes a pair of shafts journaled for rotation about respective axes parallel to the longitudinal axis and otherwise rigidly connected to the container. Each shaft supports at least two eccentric weights and a common drive motor is coupled to the shafts for rotating those shafts and eccentric weights in unison. In each form, eccentric weights are mounted on the shaft or shafts and a shaft driving motor is mounted on the frame. Rotation of the shaft or shafts causes vibration of the frame as well as the container in unison.

In operation, a minimum amount of finishing medium is required, damage due to the parts contacting each other is minimized or entirely eliminated, and consistent finishing of a relatively large number of parts is achieved in a reliable, efficient manner.

It is an object of this invention to provide for improvements in the finishing or polishing of metallic parts.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
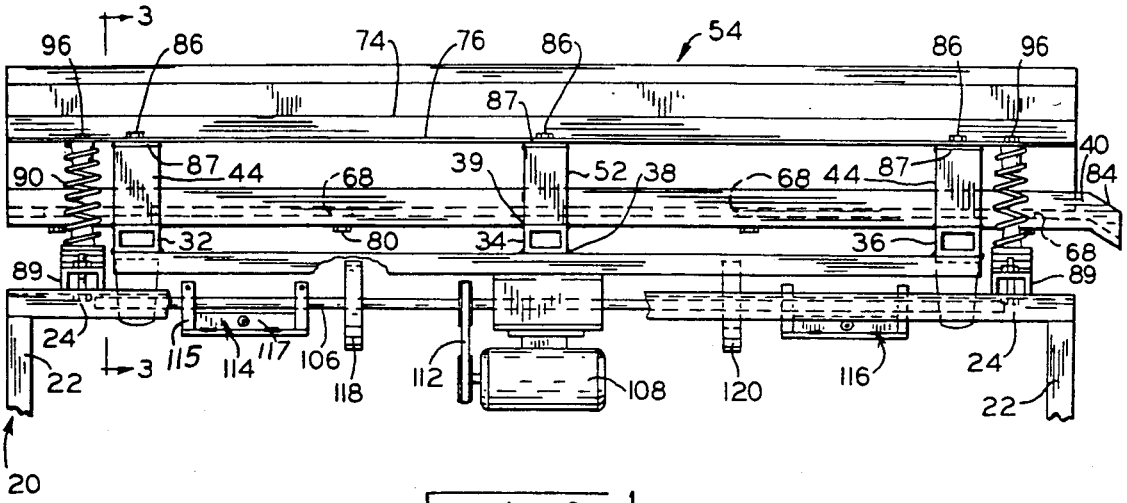
FIG. 1 is a side view of one embodiment of this invention.
Figure 2:
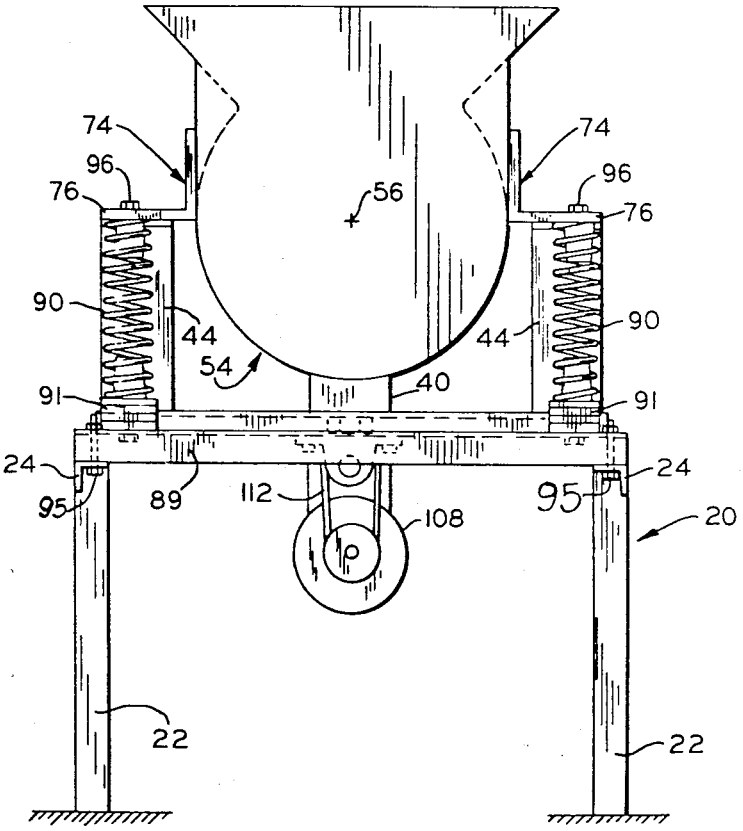
FIG. 2 is an end view thereof.
Figure 3:
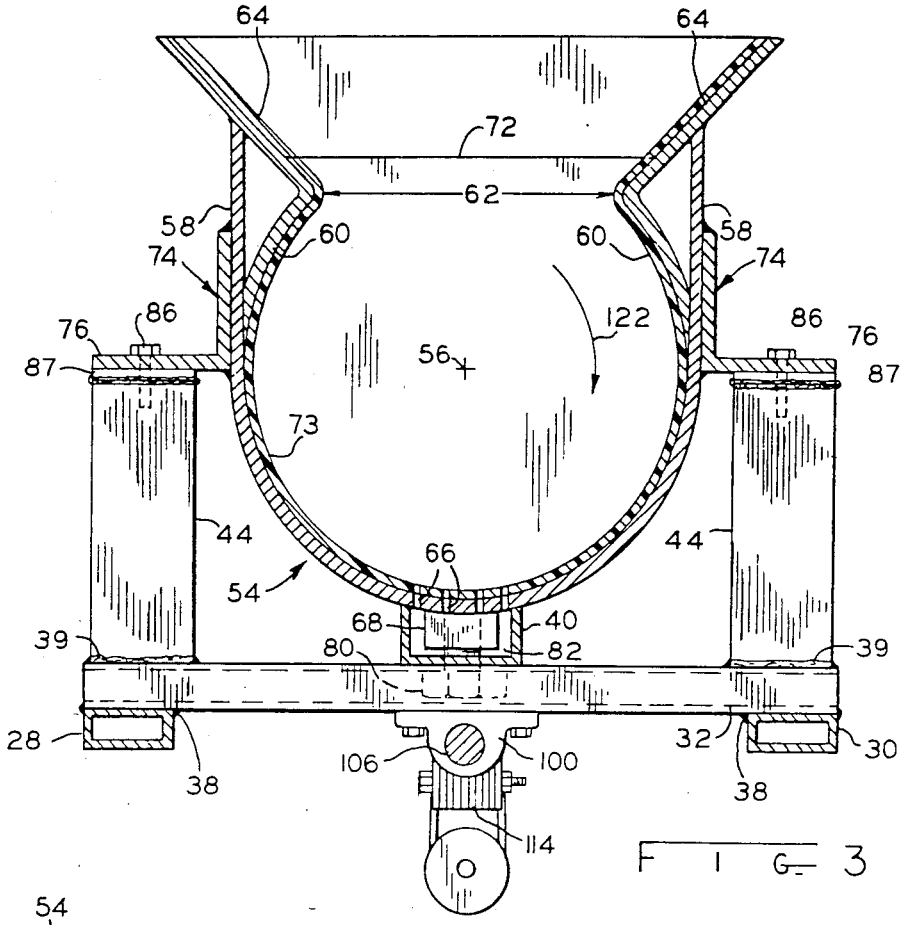
FIG. 3 is a cross section taken substantially along section line 3—3 of FIG. 1.

Referring to the drawings, and more particularly to FIGS. 1 through 3, a rigid, stationary supporting platform or frame is indicated by the numeral 20. This platform includes supporting legs 22, elongated, horizontal girders 24, and elongated cross members 26 welded thereto at the ends. The remainder of the structure which is the vibrating portion thereof is resiliently mounted on the platform 20.

Figure 4:
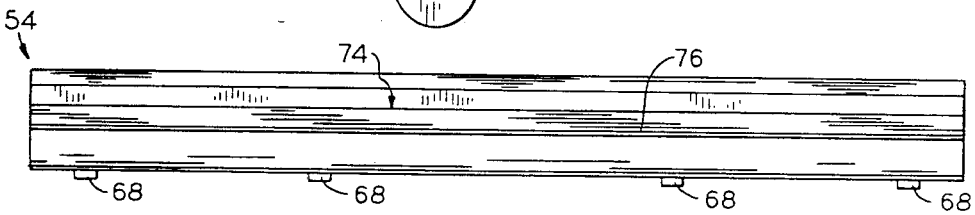
FIGS. 4, 5 and 6 are side, top and bottom views of the elongated container illustrated in the preceding figures.
Figure 5:
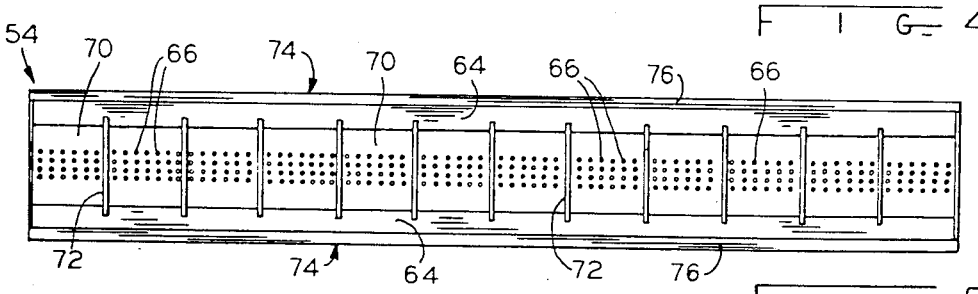
Figure 6:
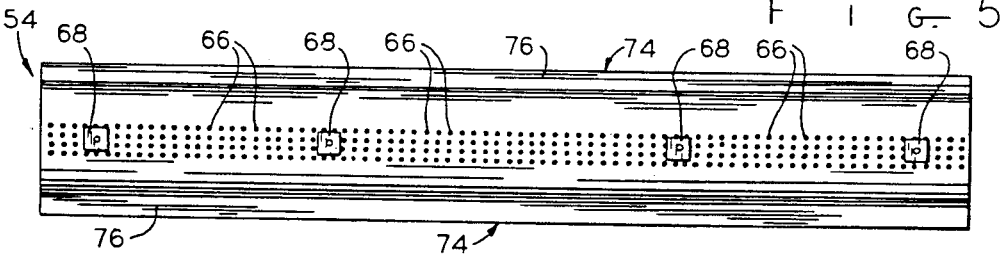
Figure 7:
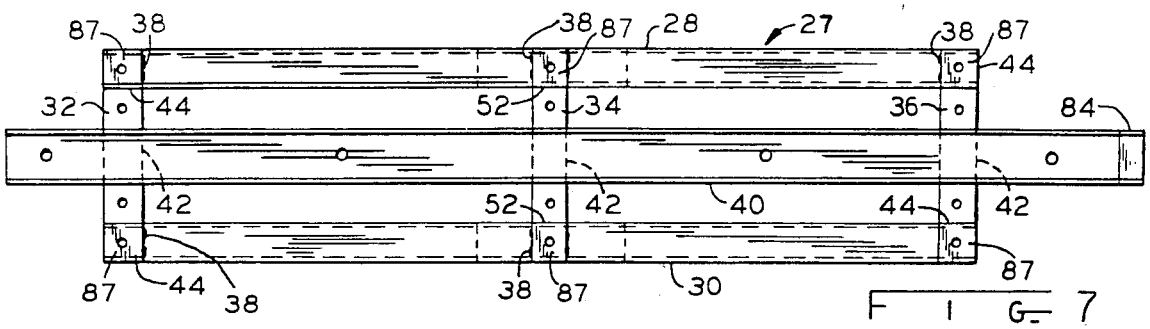
FIGS. 7 and 8 are top and side views, respectively, of the carriage frame upon which the container of FIGS. 4, 5 and 6 is mounted.
Figure 8:
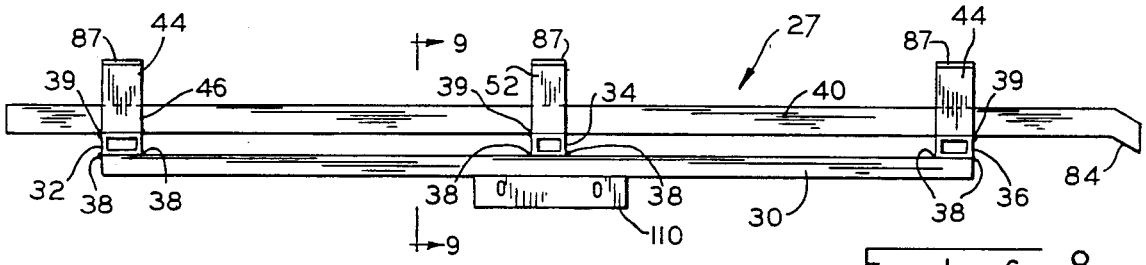
Figure 10:
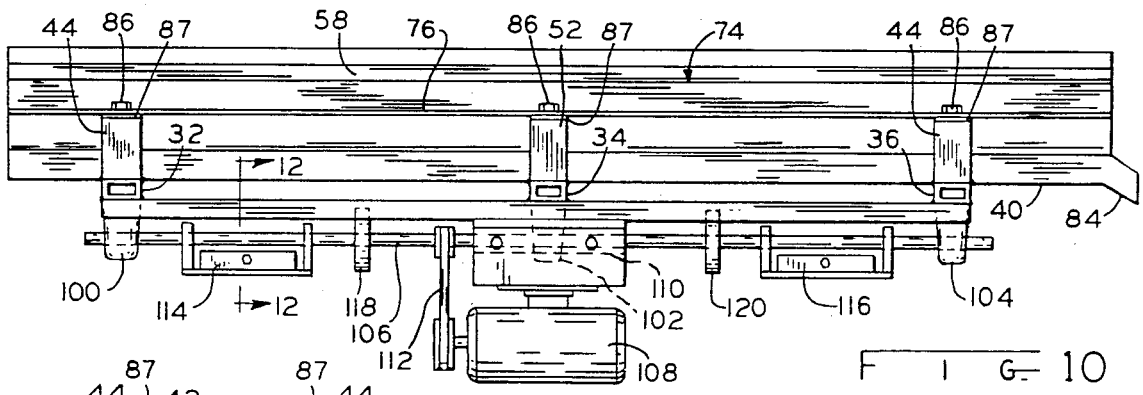
FIG. 10 is a side view of the container of FIGS. 4 through 6, as mounted on the carriage frame of FIGS. 7 and 8 and with the rotary eccentric weight mechanism mounted thereon.
Figure 9:
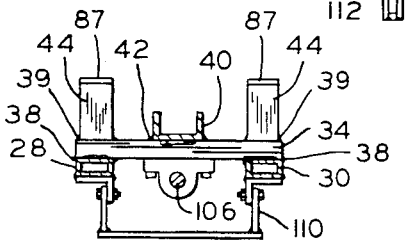
FIG. 9 is a cross section taken substantially along section line 9—9 of FIG. 8 illustrating the mount for the electric motor used to impart rotation to the eccentric-weight shaft of the apparatus shown in FIG. 1.

This remaining structure may be considered as three subassemblies, the first being the carriage frame of FIGS. 7 and 8, the elongated container of FIGS. 4 through 6, and the rotary, eccentric weight mechanism as shown in FIGS. 1, 2 and 10. Referring first to FIGS. 7 and 8, the carriage frame, generally indicated by the numeral 27, includes two lengths 28 and 30 of box-shaped iron which are spaced apart and parallel as shown. These are rigidly secured together by means of three cross members 32, 34 and 36, box-shaped in cross-section, by means of weldments 38. Another longer channel iron 40 is superposed on the three cross members 32, 34 and 36 midway between the two frame members 28 and 30 and in parallelism therewith as shown. This channel 40 is secured to the cross members by means of weldments 42.

Two pairs of upstanding posts 44 are secured to the opposite ends, respectively, of carriage frame 27, these posts 44 being welded to cross members 32 and 36 at the bases as indicated by numeral 39. Two additional upright posts 52 are welded to the opposite ends of the cross member 34 as shown, these being essentially the same as the posts 44.

The container portion of this invention will now be described, reference in particular being had to FIGS. 3 through 6. The container, closed at both ends, is indicated by the numeral 54 and, as clearly shown in FIG. 3, is part cylindrical in cross section, the numeral 56 indicating the longitudinal axis thereof. This axis 56 is normally disposed horizontally as otherwise shown in FIG. 1. The container 54 is formed to a U-shape of sheet metal, having opposite sides 58 which ar generally parallel. Elongated bars, which may be in the form of angle irons, indicated by the numeral 60, are welded to the upper portions of the sides 58 as shown in FIG. 3 thereby to serve as part-cylindrical extensions of the cylindrical bottom portion of the container 54. These part-cylindrical extensions 60 together with the bottom half of the container 54 provide a part-cylindrical shape which is greater than a half cylinder, resulting in an open container top having a transverse dimension 62 which is smaller than the largest transverse dimension or diameter of the container 54. The portion of the container above the opening 62 is straight and angled as indicated by the numeral 64, all of the parts being welded together as to provide a single, integrated assembly.

The bottom of the container 54 is provided with a multiplicity of drain orifices 66 which extend from end-to-end thereof. To the underneath side of the container 54 are welded four internally threaded nut elements 68 (FIG. 4) for a purpose later to be explained. The container is divided into a plurality of like compartments 70 by means of transverse partitions 72, these partitions being welded to the interior surfaces of the container 54. The compartments 70 are preferably of the same size and small enough as to prevent part-on-part damage as will be explained in more detail later.

The interiors of the compartments 70 and partitions 72 are lined or covered with a suitable resilient, cushioning elastomer 73. This elastomer may be either in the form of cured liquid rubber, polyurethane or the like. Such layer 73 should be relatively firm but rather easily indented with a fingernail. It is intended to serve as a cushion and liner for preventing contact of the polishing media and parts with the bare metal surfaces of the compartments 70.

To the opposite sides of the container 54 and extending in parallelism therewith are welded two angle irons 74 at a location at which the horizontal flanges are coplanar horizontally with axis 56.

Referring now to FIGS. 1, 3, 10 and 11, the container 54 is rigidly secured to the carriage frame 27. First, the container 54 is aligned to be parallel with the frame 27 and is superposed thereon by the engagement of the underneath side of the container 54 with the open side of the channel member 40. Threaded fasteners such as bolts 80 secure the channel 40 to the container 54 by being threaded into the nut members 68. This then forms a duct 82 closed at the left end as viewed in FIG. 1 but open at the right end 84 to provide a drain. As shown clearly in FIG. 3, all of the orifices 66 are in registry with the duct 82 so that any liquid or particulate matter within the container 54 may pass through the orifices 66 into the duct 82. It will be observed that the bolts 80 also serve in partially securing the carriage frame 27 to the container 54. Further securement is provided by attaching the upper ends of the posts 44 and 52 to the opposite sides of the container 54 by means of threaded fasteners 86 received through openings in the horizontal flange 76 of the angle irons 74. Fasteners 86 are threaded into plates 87 flat welded to the tops of posts 44 and 52. The container 54 and carriage frame 27 are now rigidly secured together as a unitary assembly.

Figure 11:
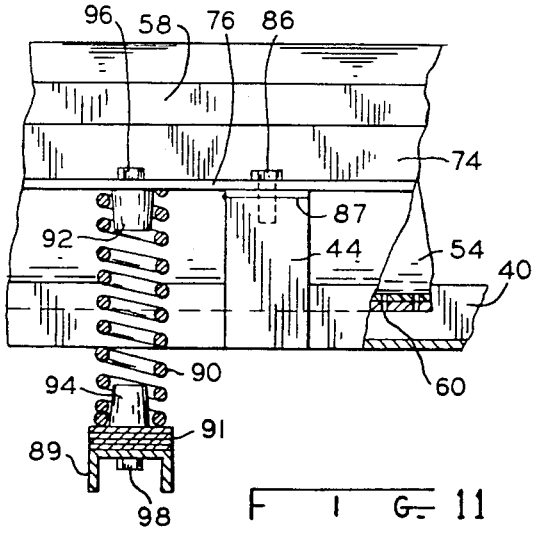
FIG. 11 is a fragmentary side view of that portion of FIG. 1 showing the construction of the mounting springs and the fluid-collecting channel which is clamped to the bottom of the elongated container.
Figure 12:
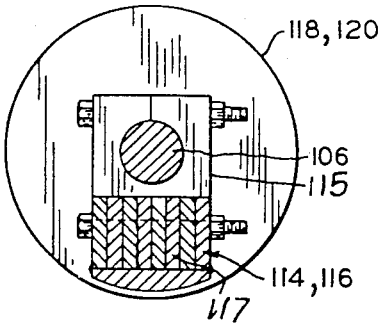
FIG. 12 is a cross section of an eccentric weight and taken substantially along section line 12—12 of FIG. 10.

This unitary assembly is spring-mounted on the platform 20 as shown more clearly in FIGS. 1, 2 and 11. Likewise, upright helical compression springs 90 are interposed between the flanges 76 and the cross bars 89 bolted to platform 20 to carry the full weight of the container-frame assembly. These springs 90 are held in place by means of cylindrical retaining pins 92 and 94 secured to the flanges 76 and cross members, respectively, by means of threaded fasteners 96 and 98. These retaining pins 92 and 94 are cylindrical and have a sliding telescoping fit with the springs 90. Cross members 89 are channels secured at the ends thereof by bolts 95. Shims 91 as needed are interposed between the pins 94, bottoms of springs 90 and cross members 89 (see FIG.

11). Since all of the springs 90 are of the same size and have the same load-carrying strength, the container 54 will be held in horizontal position assuming, of course, that the supporting frame 20 is also horizontal. As shown in FIG. 2, the springs 90 on opposite sides of the container 54 are spaced as close to the container 54 as possible and furthermore have the upper ends thereof disposed approximately horizontally even with the axis 56.

The mechanism for vibrating the container 54 and frame 27 as a unit relative to the stationary frame 20 is shown more clearly in FIGS. 1, 2, 9 and 10. Three bearings 100, 102 and 104 are secured to the undersides of the cross members 32, 34 and 36, respectively, as shown. These bearings have journalled therein a shaft 106, the bearings being suitably set to dispose the shaft 106 parallel and vertically below the axis 56 of the container 54. An electric motor 108 is carried by and depends from the carriage frame 27 by means of a suitable box-shaped platform 110 secured to the undersides of the two members 28 and 30 by means of threaded fasteners. The motor 108 is drivingly connected to the shaft 106 by means of a belt and pulley arrangement 112. As is shown in FIGS. 1 and 10, the motor 108 is centered with respect to the frame 27 and container 54.

On the shaft 106 are mounted two eccentric weights 114 and 116, each of the weights being composed of a carrier 115 and a plurality of metal plates 117 laminated and clamped together by means of a threaded fastener. The number of plates may be varied to vary the mass of the weights. Generally speaking, the weights 114 and 116 are the same and are symmetrically positioned on the shaft 106 relative to the container 54. As shown in the drawings, the weights 114 are located nearer the end bearings 100 and 104, respectively, than they are to the center bearing 102. Inboard of the weights 114 and 116 are two flywheels secured to shaft 106. Energization of the motor 108 rotates the eccentric weight assembly which includes the shaft 106, the eccentric weights 114, 116 and the flywheels 118, 120.

The pieces and parts of the apparatus are so sized and arranged that upon energization of the motor 108, the container 54 and carriage frame 27 are vibrated as a unit such that finishing material and parts within the container 54 is given a rotary or orbital movement clockwise about the axis 56 as indicated by the arrow 122 in FIG. 3. Such orbital movement in similar apparatuses is conventional. For one working embodiment, a suitable speed of rotation for the shaft 106 is 1300 rpm.

In use, all of the compartments 70 are charged with suitable finishing material, such as steel balls. Such balls are filled to a level slightly below that of the opening 62 (FIG. 3). Parts to be polished, such as brass or aluminum are placed in the individual compartments 70, the number being limited by trial and error to allow for a maximum number of parts as will not produce part-on-part damage due to interpart impingement. Such number of parts may be increased from batch to batch, with the resultant finish being observed at the end of each polishing operation. Should an excessive number be processed, the resultant finish will be inferior than in processing a fewer number.

In a working embodiment, it has been found that about 20 pounds of steel balls in a single compartment 70 performs a satisfactory polishing action.

Once the motor 108 is energized, the container will be vibrated such that the finishing medium and parts will enmasse be rotated about the axis 56. By reason of the gentle rolling and vibratory rubbing motion, fines and sediment may be developed. Unless these are removed, both the media and parts will become dirty or contaminated which detracts from the appearance of the polish on the parts. This problem is overcome by using a suitable cleaning compound, such as a detergent, soap, surfactant, wetting agent and the like. A small quantity of such material is poured into each of the compartments 70 while the apparatus is operating. This material will filter down through the media and parts and will eventually drain through the orifices 66 into the collecting duct 82. From the collecting duct, this drainage will empty from the end 84 of the channel 40. Trial and error is again employed for the purpose of optimizing the amount of such cleaning compound used. Too little or too much such compound can result in an undesired finish. Adding a small quantity about twice an hour is all that is required in one working embodiment.

Since each compartment 70 has its individual drain orifices 66, it is seen that such liquid cleaning material, fines and sediment will be scavenged from each compartment thereby maximizing the cleaning action. If orifices 66 were provided in only one end of the container 54, for example in the right end, the cleaning compound as well as the fines and sediment would have to travel from the opposite end portions of the container all the way through the media and parts. The net result would be that the media and parts at the right hand end would have circulated therethrough the dirty or contaminated materials from the other end such that a uniform, consistent polishing action could not be obtained.

By reason of the partitions 72, the parts of one compartment are prevented from co-mingling with parts in another. If the partitions 72 were absent, the parts would tend to collect in localized regions, circulate and impinge each other to an extent as could cause damage. By providing the partitions, the parts are maintained separated thereby resulting in optimum polishing action of a uniform, consistent nature in each individual compartment. For this reason, more parts may be polished in a single batch within the container 54 than otherwise would be possible.

As explained earlier, the interior surfaces of the container 54 and partitions 72 are coated with a suitable resilient, cushioning elastomer thereby to prevent the parts and media from contacting the metallic surfaces of the container 54. Such an elastomer may be in the form of solidified liquid rubber, polyurethane or the like. The resilience and friction presented by the elastomer works in conjunction with the media and parts thereby to prevent parts damage and furthermore to promote rolling and circulation which will assure uniform polishing action.

Since the shape of the container 54 is more than a half cylinder, the parts tend to remain submerged within the polishing media during the orbital movement thereof. By maintaining submergence, the parts are subjected to the polishing action of the media for the entire cycle of polishing. This expedites and assures uniform finishing.

The motion of the mass within the compartment 70 is affected by the various pieces and parts of the apparatus and in particular by the eccentric weight mechanism. It has been found that the flywheels 118 and 120 smooth out the operation of the system such that the movement of the mass within the compartments is primarily smoothly orbital as compared with a combination of orbital and random vibration in the absence of the flywheels. Also, the sizes and positions of the weights 114 on the shaft 106 are important as are the positions, sizes and mounting of the springs 90. The retaining pins 92 and 94 can be varied in length to cause a modification of the vibratory movement of the material within the container 54. Desirably, all of the parts are so adjusted that the movement of the mass will be primarily orbital about the axis 56 with the parts remaining submerged for the most part within the polishing media throughout the polishing cycle.

By reason of the particular eccentric weight mechanism, since it extends beneath and primarily parallel to the longitudinal axis of the container 54, it is possible to make the container longer than shown. In order to do so, it is only necessary to lengthen the carriage frame 27, employ additional bearings 100, 102, 104 and otherwise to lengthen the shaft 106 as well as add to the shaft eccentric weights and flywheels. Thus an economical and simple expedient is provided for varying machine size which for the most part involves making the container 54 larger.

Comparing FIG. 13 to FIG. 1, and FIG. 14 to FIG. 2, like reference numerals indicate like structure having a like function as already discussed in reference to FIGS. 1 and 2. The embodiment of FIGS. 13 and 14 differs from that previously discussed principally in the provision of a pair of co-rotating, eccentric bearing shafts; modification of the parts container and the separators therein; and changes in the drain arrangement in the lowermost portion of the container. Container 129 of FIG. 14 differs from container 54 of FIGS. 2 and 3 in that the container shell 131 is a generally simple U-shaped configuration and lined with a molded urethane liner 133 to provide the keyhole or less than complete cylindrical configuration. The partitions or separators such as 72 are replaced in FIG. 14 with removable separators 135, which are removably fastened in place by threaded fasteners such as 137 and 139 engaging the container shell 131 and supporting the dividers within the container at preferred locations. The outline dimensions of the divider or partition 135 are slightly smaller than the inner dimensions of the urethane liner 133 to facilitate placement and removal of those partitions.

Figures 13, 15, 16:
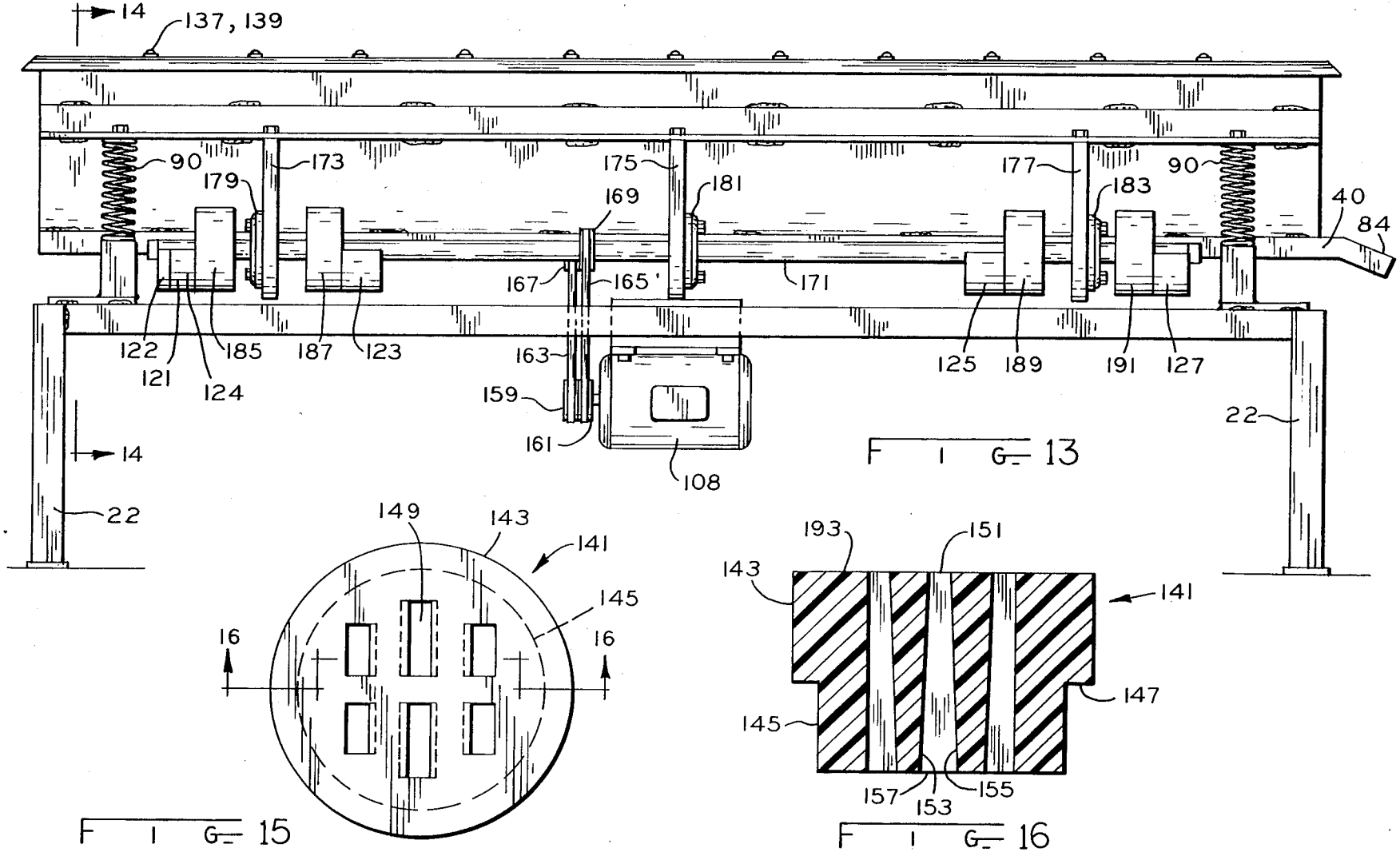
FIG. 13 is a side view similar to FIG. 1 but illustrating a second embodiment of the present invention.
FIG. 15. is a top view of a stepped cylindrical plug which may be used as a compartment drain as depicted in FIG. 14.
FIG. 16 is a view in cross section along the lines 16—16 of the plug of FIG. 15.
Figure 14:
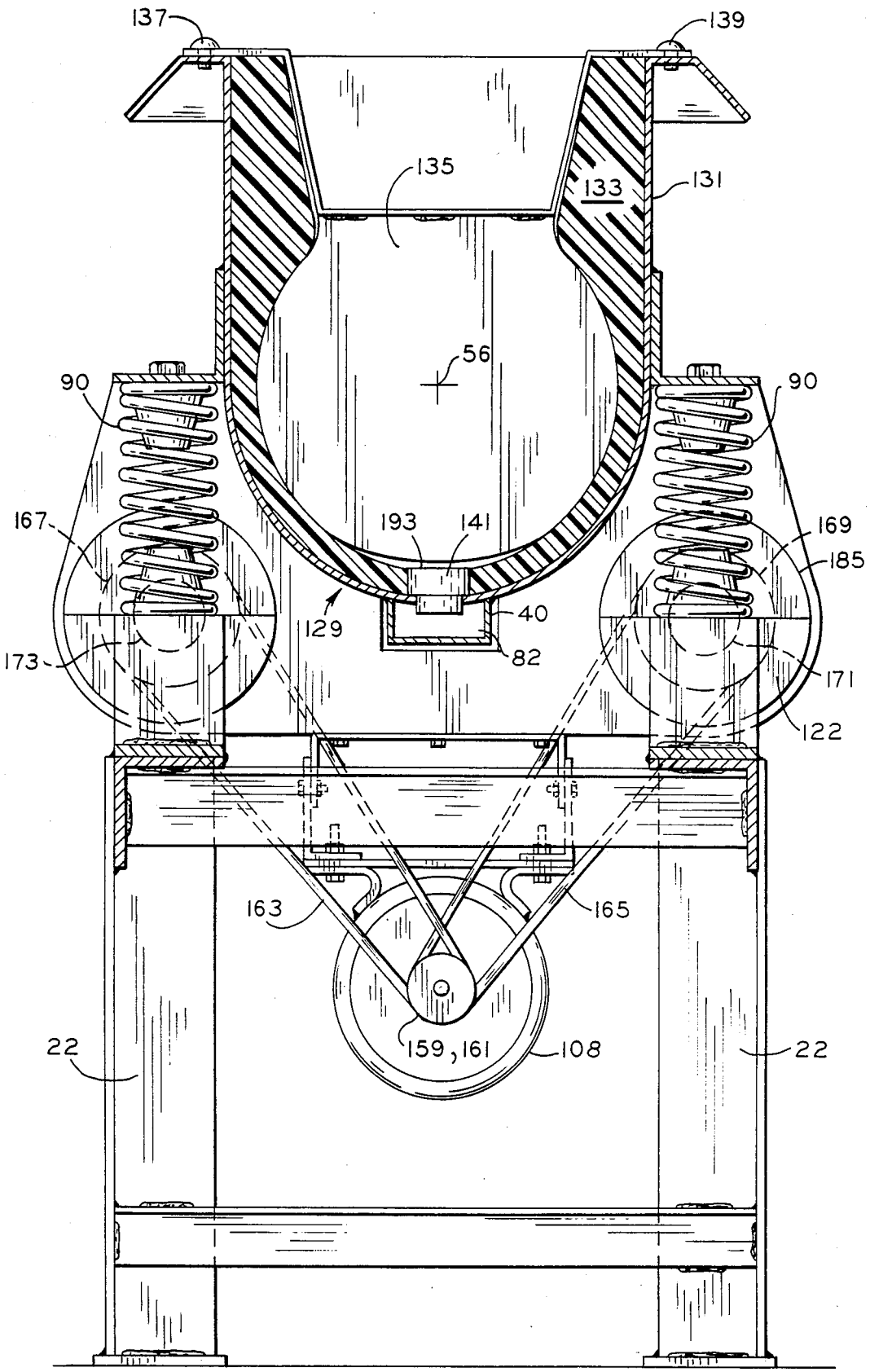
FIG. 14 is a view similar to FIG. 2 but illustrating the embodiment of FIG. 13 in cross section along lines 14—14 of FIG. 13.

As best seen in FIGS. 3 and 5, the lowermost region of container 54 was provided with a plurality of through erifices or drain holes 66. In certain finishing operations, it was discovered that these drain holes tended to become clogged or plugged, requiring in some instances periodic inspection followed by back flushing or some other corrective technique to unplug the drain holes and assure free drainage of the periodic detergent rinsing of the parts being finished and the finishing media within the container. As illustrated in FIGS. 14, 15 and 16, this occasional drain hole blockage has been essentially eliminated by configuring the compartment drain means as an apertured insert 141 passing through a hole in the bottom of the container. Preferably there is at least one such apertured insert for each compartment defined by the dividers 135.

The apertured insert is formed of two cylindrical portions 143 and 145 with portion 143 having a greater outside diameter than portion 145. Between the two cylindrical portions there is defined an annular shoulder 147 which, as seen in FIG. 14, rests on the bottom of the metallic shell 131, while the urethane liner 133 has a somewhat greater diameter hole therethrough for accomodating the cylindrical portion 143. Thus the stepped cylindrical plug is held in the position illustrated in FIG. 14 by the cooperation of this shoulder 147 and the periphery of the smaller diameter hole in the shell 131. Cylindrical plug 141 has a plurality such as six through holes for passing water and particulate material from the respective compartments into the common compartment drain trough 82. As best seen in FIGS. 15 and 16, these through holes are formed as relieved elongated slots which increase in cross sectional area in the downward direction of fluid drainage. This relief or widening of the slot in the direction of fluid flow eliminates any potential obstruction forming constrictions and substantially eliminates the drainage flow blockage problems heretofore occasionally encountered in the first embodiment of this invention. For example, in comparing FIGS. 15 and 16 the elongated slot 149 has a relatively narrow initial entry slot at 151 with both side walls 153 and 155 being relieved or tapering outwardly somewhat so that the exit 157 from that slot is significantly wider than the entrance 151. The remaining five slots may be analagously relieved.

Referring primarily to FIGS. 13 and 14, drive motor 108 supports a pair of pulleys 159 and 161 on its rotor shaft. These pulleys may be of the notched variety to receive toothed timing belts such as 163 and 165 with those timing belts connecting respectively to similarly toothed pulleys 167 and 169, with these pulleys, in turn, drivingly connected to shafts 173 and 171, respectively. Thus motor rotation induces co-rotation of the shafts 171 and 173 in timed sychronism with one another. The shafts 171 and 173 are similarly journaled and similarly support flywheel weights and eccentric weights and only the details associated with shaft 171 will be discussed.

A series of bearing supporting plates or panels 173, 175 and 177 are affixed to the carriage frame or to the container and in turn receive bearings at 179, 181 and 183, which bearings allow relatively free rotation of the shaft 171 therein. The shaft has affixed thereto a series of flywheel weights, such as 185, 187, 189 and 191. These flywheel weights are analagous to the flywheels 118 and 120 of FIG. 1, but are, however, threaded or otherwise adapted to receive the eccentric weights 121, 123, 125 and 127. An appropriate number of approximately semicircular plates such as 122 and 124 may be bolted together to form the eccentric weights giving a desired eccentric mass tailored to a particular finishing operation. It should be noted in FIG. 13 that the flywheel weights such as 185 and more particularly the eccentric weights such as 121 are mounted to shaft 171 relatively close to the corresponding shaft support bearing such as 179 so that problems of flexing of the shaft 171 are minimized. With this arrangement, co-rotation of the eccentric weight supporting shafts 171 and 173 induces the desired vibratory motion to the container 129 and its contents.

The embodiment of FIGS. 13, 14, 15 and 16 has been successfully used to finish aluminum parts immersed in a media of steel balls with periodic rinsing as by a detergent and water, the rinsing both the parts and the media and exiting the respective compartments of the container by way of the apertured plugs such as 141. The rinsing material, together with fines and sediments, drains into the common fluid-collecting channel 82 as before.

Comparing FIGS. 3 and 14, the device of FIG. 3 has a single eccentric supporting shaft 106 whereas the device of FIG. 14 has a pair of eccentric supporting shafts 171 and 173. With the device of FIG. 3, the vibratory gyrating motion imparted to the container 54 was found to be a generally elliptical motion with that ellipse elongated in the vertical direction, whereas the vibratory gyrating motion imparted to the container 129 of FIG. 14 very closely approaches a circular motion. With such a circular motion, a generally circular migration of the parts and media within the container is more easily created. It has also been found that the circular migration of the parts and media is significantly impeded by any protusions or irregularities in the compartment liner, thus the upper surface 193 of the apertured insert is made to lie flush with the inner surface of the urethane liner 133, thereby reducing impediments to the circular migration of the parts and the media to a minimum. The more nearly circular orbital motion of the container 129, as well as the elimination of impediments to rotation of the finishing material and parts within the compartments, both lead to more suitable and efficient polishing or other part finishing processes.

Given in the following are dimensions and parameters of a typical working embodiment of FIGS. 1–12 of this invention, these being exemplary only and not limitative of the invention. The scope of the invention is given in the claims appended hereto.

| | |
|---|---|
| Container 54, outside diameter | 6½" |
| Radius of container 54 | 3¼" |
| Height of sides 58 between the bottom of container 54 to the divergent flanges 64 | 6½" |
| Height of container 54 | 7½" |
| Length of container 54 | 60" |
| Length of compartments 70 (between partitions 72) | 5" |
| Location of posts 44 from opposite ends of container 54 | 7" |
| Location of four female nut elements 68 from one end of container 54 | 3", 18½", 4½", 57" |
| Length of elements 28, 30 (same as longitudinal distance between posts 44) | 48" |
| Spacing between elements 28 and 30, center line to center line (also spaces between centers of springs 90) | 9⅛" |
| Distance between center line of posts 44 and adjacent springs 90 | 2⅝" |
| Height of posts 44 and 52 | 5" |
| Width of posts 44 and 52 | 5" |
| Outer diameter of retaining pins 92, 94 | 1⅛" |
| Length of retaining pins 92, 94 | 1¼" |
| Length of springs 90 | 5" |
| Inner diameter of springs 90 | 1⅛" |
| Outer diameter of springs 90 | 1⅝" |
| Pitch of springs 90 | 2 turns per inch |
| Outer Diameter of wire in springs 90 | ¼" |
| Distance between center of shaft 106 and bottom of container 54 | 4⅛" |
| Outside diameter of shaft 106 | 1¼" |
| Shaft 106 material | Cold rolled steel |
| Location of weights 114, 116 on shaft 106 from vertical line through end fasteners 86 to weights 114, 116, respectively | 2" |
| Length of each carrier 115 | 8" |
| Distance from axis of shaft 106 and outer extremity of weight 114, 116 | 2⅝" |
| Mass of the plates 117 and carrier 115 of each weight 114, 116 | 9 lbs. |
| Outside diameter of each flywheel 118, 120 | 5" |
| Width of each flywheel 118, 120 | 1" |
| Weight of each flywheel 118, 120 | 5 lbs. 3oz. |
| Location of each flywheel from center bearing 102 | 8" |
| Speed of shaft 106 | 1300 rpm. |
| Rating of motor 108 | 1 hp. |

The mass of weights 114, 116 or 121, 123, 125 and 127 may be adjusted by varying the number of plates (FIG. 12 or FIG. 13 respectively) in order to obtain adjustment of the vibratory characteristic.

While there have been described above the principles of this invention in connection with specific apparatus, it is to be clearly understood that this description is made only by way of example and not as a limitation to the scope of the invention.

What is claimed is:

1. A finishing chamber for a vibrating finishing apparatus comprising an elongated container having an open top, said container being disposed with its longitudinal axis horizontal, a liner disposed within said container, said liner being separately molded of a resilient elastomeric material, means for dividing said container into a plurality of positionally fixed individual compartments arranged in tandem from end-to-end thereof, compartment drain means in the bottom of each compartment for allowing the egress of fluid and particulate matter from the compartment, a single elongated fluid-collecting channel disposed beneath said container to collect fluid and particulate matter which drains from said compartments, each compartment drain means comprising at least one apertured insert passing through a hole in the bottom of the container.

2. The apparatus of claim 1 wherein each apertured insert is formed as a stepped cylindrical plug having an annular shoulder between greater and lesser outside diameter cylindrical portions and having a plurality of fluid passing through holes extending between opposite plug ends, said holes in the bottom of the container accepting said lesser outside diameter cylindrical portions of said plugs, said greater outside diameter cylindrical portions of said plugs being disposed inwardly of said container.

3. The apparatus of claim 2 wherein the through holes of each plug are formed as relieved elongated slots increasing in cross-sectional area in the direction in which fluid drains through said plug.

4. The apparatus of claim 1 wherein each apertured insert has an upper surface flush with the bottom of its respective compartment, as defined by a surface of said liner disposed inwardly of said container.

5. The apparatus of claim 1 wherein the means for dividing comprises a plurality of removable transverse panels selectively positionable to provide positionally fixed compartments of preferred sizes.

6. The apparatus of claim 1 further comprising means, rigidly coupled to said container, for agitating the container and its compartments.

7. The apparatus of claim 6 wherein said container and compartments are part-cylindrical about said axis, said agitating means being adapted to impart an orbital motion to said container in a generally transverse vertical plane which causes finishing material and parts within said compartments to rotate generally about said axis, and which concurrently causes finishing material and parts within said compartments to gyrate generally about each other.

8. The apparatus of claim 7 wherein said part-cylindrical shape is greater than a half cylinder with the transverse dimension of said open top being less than the maximum transverse dimension of the cylinder.

9. The apparatus of claim 1 wherein the resilient elastomeric material lining is molded urethane.

10. The apparatus of claim 6 wherein said agitating means comprises a pair of shafts journaled for rotation about respective axes parallel to said longitudinal axis and otehrwise rigidly connected to said container, at least two equal eccentric weights on each shaft, a common drive motor, mounted on said container and coupled to the shafts for rotating the shafts and eccentric weights in unison, and means resiliently supporting the container, shafts and drive motor, said shafts being disposed at a mutual elevation approximating the lowermost surface of said container and at transversely opposed horizontal positions most proximate to an imaginary vertical plane longitudinally bisecting said container while providing rotational clearance for said eccentric weights.

11. Finishing apparatus comprising an elongated container having an open top, said container being disposed with its longitudinal axis horizontal; means, transversely disposed for dividing said container into a plurality of individual positionally fixed compartments arranged in tandem from end-to-end thereof; compartment drain means, disposed in the bottom of each compartment, for allowing the egress of fluid and particulate matter from each compartment; a single elongated fluid-collecting channel disposed beneath said container to collect fluid and particulate matter which drains from said compartments; and means for agitating the container and its compartments comprising a pair of shafts journaled for rotation about respective axes parallel to said longitudinal axis and otherwise rigidly connected to said container, at least two equal eccentric weights on each shaft, a common drive motor, mounted on said container and coupled to the shafts for rotating the shafts and eccentric weights in unison, and means resiliently supporting the container, shafts and drive motor, said shafts being disposed at a mutual elevation approximating the lowermost surface of said container and at transversely opposed horizontal positions most proximate to an imaginary vertical plane longitudinally bisecting said container while providing rotational clearance for said eccentric weights.

12. The apparatus of claim 11 wherein each compartment drain means comprises at least one apertured insert passing through a hole in the bottom of the container.

13. The apparatus of claim 12 wherein each apertured insert is formed as a stepped cylindrical plug having an annular shoulder between greater and lesser outside diameter cylindrical portions and having a plurality of fluid passing through holes extending between opposite plug ends, said holes in the bottom of the container accepting said lesser outside diameter cylindrical portions of said plugs, said greater outside diameter cylindrical portions of said plugs being disposed inwardly of said container.

14. The apparatus of claim 14 wherein the through holes of each plug are formed as relieved elongated slots increasing in cross-sectional area in the direction in which fluid drains through said plug.

15. The apparatus of claim 12 wherein each apertured insert has an upper surface flush with the bottom of its respective compartment.

16. The apparatus of claim 11 wherein the means for dividing comprises a plurality of removable transverse panels selectively positionable to provide positionally fixed compartments of preferred sizes.

17. The apparatus of claim 11 wherein said container and compartments are part-cylindrical about said axis, said agitating means being adapted to impart an orbital motion to said container in a generally transverse vertical plane which causes finishing materials and parts within said compartments to rotate generally about said axis and which concurrently causes finishing material and parts within said compartments to generally gyrate about each other.

18. Finishing apparatus comprising an elongated container having an open top, said container being disposed with its longitudinal axis horizontal; drain means, spacedly distributed in the bottom of the container, for allowing the egress of fluid and particulate matter from the container; and means for agitating the container comprising a pair of shafts journaled for rotation about respective axes parallel to said longitudinal axis and otherwise rigidly connected to said container, at least two equal eccentric weights on each shaft, a common drive motor, mounted on said container and coupled to the shafts for rotating the shafts and eccentric weights in unison, and means resiliently supporting the container, shafts and drive motor, said shafts being disposed at a mutual elevation approximately the lowermost surface of said container and at transversely opposed horizontal positions most proximate to an imaginary vertical plane longitudinally bisecting said container while providing rotational clearance for said eccentric weights.

19. The apparatus of claim 18 wherein the drain means comprises a plurality of apertured inserts each formed as a stepped cylindrical plug having an annular shoulder between greater and lesser outside diameter cylindrical portions and having a plurality of fluid passing through holes extending between opposite plug ends, the through holes formed as relieved elongated slots increasing in cross-sectional area in the direction in which fluid drains through said plugs, each apertured insert having an upper surface at one plug end flush with the bottom of the container, said apertured inserts passing through corresponding holes in the bottom of said container such that said lesser diameter cylindrical portons of said plugs pass through said holes in the bottom of the container, said greater diameter cylindrical portions of said plugs being disposed inwardly of said container, and said annular shoulders of said plugs rest on similar shoulders formed n said holes in the bottom of the container.

* * * * *